US009824646B2

(12) United States Patent
Shimmen

(10) Patent No.: US 9,824,646 B2
(45) Date of Patent: Nov. 21, 2017

(54) LIQUID CRYSTAL DISPLAY DEVICE

(71) Applicant: Japan Display Inc., Tokyo (JP)

(72) Inventor: Ryou Shimmen, Tokyo (JP)

(73) Assignee: Japan Display Inc., Tokyo (JP)

( * ) Notice: Subject to any disclaimer, the term of this patent is extended or adjusted under 35 U.S.C. 154(b) by 21 days.

(21) Appl. No.: 14/743,554

(22) Filed: Jun. 18, 2015

(65) Prior Publication Data

US 2015/0371597 A1 Dec. 24, 2015

(30) Foreign Application Priority Data

Jun. 18, 2014 (JP) ..... 2014-124933

(51) Int. Cl.
*G09G 3/34* (2006.01)
*G09G 3/36* (2006.01)

(52) U.S. Cl.
CPC ..... *G09G 3/3607* (2013.01); *G09G 3/3611* (2013.01); *G09G 2300/0426* (2013.01); *G09G 2300/0439* (2013.01); *G09G 2300/0447* (2013.01); *G09G 2300/0452* (2013.01)

(58) Field of Classification Search
None
See application file for complete search history.

(56) References Cited

U.S. PATENT DOCUMENTS 8,736,591 B2 * 5/2014 Yamashita ..... G09G 3/3648 345/204
8,891,044 B2 * 11/2014 Hirota ..... G09G 3/3607 349/106
9,653,033 B2 * 5/2017 Kobayashi ..... G09G 3/3648
2005/0140897 A1 * 6/2005 Kim ..... G02F 1/134363 349/141
2005/0270444 A1 * 12/2005 Miller ..... G09G 3/3216 349/108
2007/0057297 A1 * 3/2007 Kim ..... G02F 1/136213 257/291
2007/0085959 A1 * 4/2007 Kim ..... G02F 1/1345 349/143

(Continued)

FOREIGN PATENT DOCUMENTS

JP 4414824 B2 2/2010

*Primary Examiner* — Kent Chang
*Assistant Examiner* — William Lu
(74) *Attorney, Agent, or Firm* — Typha IP LLC

(57) ABSTRACT

A liquid crystal display device includes a display area in which pixels are disposed in a matrix with rows and columns. The display area includes first and second configuration columns. The first configuration column is a column where first pixels are aligned. The first pixels each include a pixel electrode including first and second areas. In the first area, electrodes extending in a first direction inclined to the column direction are disposed. In the second area, electrodes extending in a second direction inclined differently from the first direction are disposed. The second configuration column is a column where second and third pixels are alternately aligned. The second pixels each include a pixel electrode including electrodes extending in a third direction inclined to the column direction. The third pixels each include a pixel electrode including electrodes extending in a fourth direction inclined differently from the third direction.

6 Claims, 13 Drawing Sheets

(56) References Cited

U.S. PATENT DOCUMENTS

2007/0109482 A1* 5/2007 Kim ..... G02F 1/133707 349/144
2008/0290794 A1* 11/2008 Yuasa ..... G09G 3/3225 313/504
2009/0207328 A1* 8/2009 Hur ..... G02F 1/133707 349/37
2010/0182345 A1* 7/2010 Shimoshikiryoh ..... H01L 29/66757 345/690
2011/0025723 A1* 2/2011 Kim ..... H01L 27/3218 345/690
2012/0268418 A1* 10/2012 Ishizaki ..... G06F 3/0412 345/174
2013/0135845 A1* 5/2013 Matsui ..... G09F 13/04 362/97.1
2013/0229326 A1* 9/2013 Kamada ..... G09G 3/3648 345/32

* cited by examiner

LIQUID CRYSTAL DISPLAY DEVICE

CROSS-REFERENCE TO RELATED APPLICATION

The present application claims priority from Japanese application JP2014-124933 filed on Jun. 18, 2014, the content of which is hereby incorporated by reference into this application.

BACKGROUND OF THE INVENTION

1. Field of the Invention

The present invention relates to a liquid crystal display device.

2. Description of the Related Art

Liquid crystal display devices have been widely used as display devices of information communication terminals such as computers, or television receivers. The liquid crystal display device is a device to display an image by changing the alignment of a liquid crystal composition sealed between two substrates with a change in electric field, and controlling the degree of transmission of light passing through the two substrates and the liquid crystal composition. In order to change the electric field, a voltage corresponding to the gray-scale value of each of pixels is applied to a pixel electrode via a pixel transistor of each of the pixels.

In a so-called in-plane switching (IPS) type liquid crystal display device in which the pixel electrode and a counter electrode that forms the electric field in combination with the pixel electrode are formed in the same thin film transistor (TFT) substrate, white display is changed into blue one or yellow one depending on viewing angle directions, and thus image quality is reduced in some cases. It has been known for solving this image quality reduction to use a dual-domain structure in which two areas (domains) where electrodes extend in different directions are formed in each of the pixels to vary the alignment state of the liquid crystal composition, and thus the changes in color are canceled out each other Japanese Patent No. 4414824 discloses a liquid crystal display device in which a pixel is divided into four domains to thereby improve viewing angle characteristics.

In the dual-domain structure described above, since the liquid crystal composition is not operated at a portion at which the direction of the electrode changes and the portion is not used as the effective area of the pixel, there is a risk of a reduction in transmittance.

SUMMARY OF THE INVENTION

The invention has been made in view of the circumstances described above, and it is an object of the invention to provide an IPS type liquid crystal display device with improved transmittance.

Representative liquid crystal display devices for solving the problem are as follows.

(1) A liquid crystal display device comprising a display area having a plurality of pixels disposed in a matrix with rows and columns, the display area including a first configuration column and a second configuration column, the first configuration column being a column having a plurality of first pixels aligned therein, the plurality of first pixels each including a pixel electrode including a first area and a second area, the first area having a plurality of electrodes disposed therein, the plurality of electrodes extending in a first direction inclined to the column direction, the second area having a plurality of electrodes disposed therein, the plurality of electrodes extending in a second direction inclined differently from the first direction, the second configuration column being a column having a plurality of second pixels and a plurality of third pixels alternately aligned therein, the plurality of second pixels each including a pixel electrode including a plurality of electrodes extending in a third direction inclined to the column direction, the plurality of third pixels each including a pixel electrode including a plurality of electrodes extending in a fourth direction inclined differently from the third direction.

(2) In the liquid crystal display device according to (1), the width of each of the second pixel and the third pixel in the row-direction is larger than the width of the first pixel in the row-direction.

(3) In the liquid crystal display device according to (1) or (2), the display area includes a first column located in the first configuration column and including some first pixels that emit light in a red wavelength range, a second column located in the first configuration column and including some first pixels that emit light in a green wavelength range, and a third column located in the second configuration column and including some second pixels that emit light in one of blue and white wavelength ranges and some third pixels that emit light in the other of the blue and white wavelength ranges.

(4) In the liquid crystal display device according to any one of (1) to (3) , one first pixel in which the first area and the second area are aligned in this order in the column direction and one first pixel in which the second area and the first area are aligned in this order in the column direction are alternately disposed in the first configuration column, two first areas are adjacent to each other in two first pixels aligned adjacent to each other in the column direction, two second areas are adjacent to each other in other two first pixels aligned adjacent to each other in the column direction, the second pixel is disposed adjacent in the row direction to an area between the two first areas aligned adjacent to each other in the column direction, and the third pixel is disposed adjacent in the row direction to an area between the two second areas aligned adjacent to each other in the column direction.

(5) In the liquid crystal display device according to (4), the third direction is the first direction, and the fourth direction is the second direction.

(6) In the liquid crystal display device according to (4) or (5), the liquid crystal display device further includes a scanning signal line connected to a gate of a pixel transistor whose source or drain is connected to the pixel electrode, and the scanning signal line is disposed to be bent so as to pass between the two first pixels aligned adjacent to each other in the column direction and between the second pixel and the third pixel.

(7) In the liquid crystal display device according to (4) or (5), the liquid crystal display device further includes a scanning signal line connected to a gate of a pixel transistor whose source or drain is connected to the pixel electrode, and the scanning signal line is disposed to extend so as to pass between two first pixels adjacent to each other, divide the second pixels, and divide the third pixels.

DETAILED DESCRIPTION OF THE INVENTION

Figure 1:
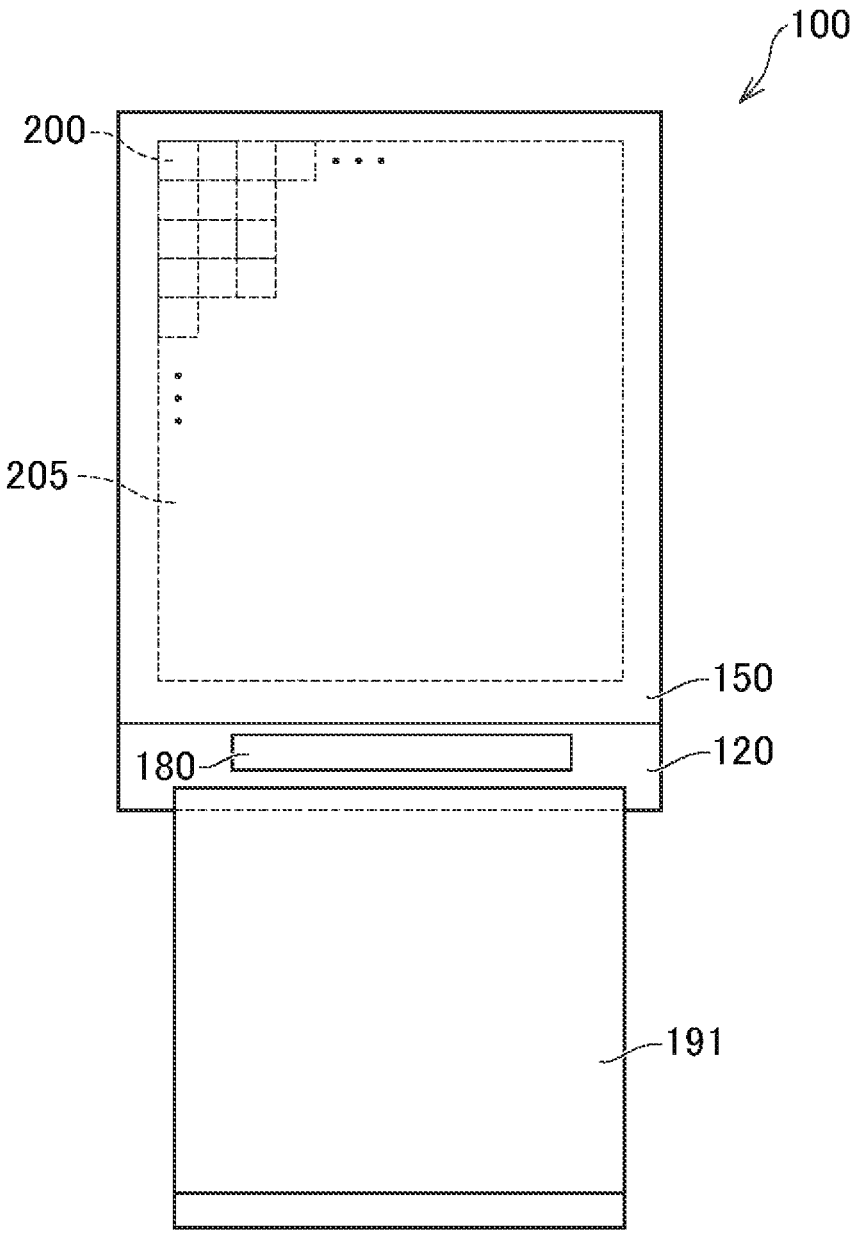
FIG. 1 is a diagram schematically showing a liquid crystal display device according to an embodiment of the invention.

Hereinafter, embodiments of the invention will be described with reference to the drawings. The disclosure is illustrative only. Appropriate modifications that will readily occur to those skilled in the art and fall within the gist of the invention are of course included in the scope of the invention. In the drawings, the width, thickness, shape, and the like of each part may be schematically represented, compared to those in practicing aspects of the invention, for more clarity of description. However, they are illustrative only, and do not limit the interpretation of the invention. Moreover, in the specification and the drawings, elements similar to those described in relation to a previous drawing are denoted by the same reference numerals and signs, and a detailed description may be appropriately omitted.

FIG. 1 schematically shows a liquid crystal display device 100 according to an embodiment of the invention. As shown in the drawing, the liquid crystal display device 100 includes two substrates, a thin film transistor (TFT) substrate 120 and a counter substrate 150, which overlap each other. For the TFT substrate 120 and the counter substrate 150 of the liquid crystal display device 100, a display area 205 including pixels 200 disposed in a matrix is formed.

The TFT substrate 120 is a substrate formed of transparent glass or a resin insulating material. A driver integrated circuit (IC) 180 as a semiconductor integrated circuit element is placed on the TFT substrate 120. The driver IC 180 applies, to a scanning signal line connected to gates of pixel transistors each of which is disposed in the pixel 200, a voltage for establishing electrical continuity between a source and a drain, and also applies, to a video signal line, a voltage corresponding to the gray-scale value of the pixel 200. Moreover, a flexible printed circuit (FPC) 191 for inputting an image signal or the like from the outside is attached to the TFT substrate 120. The liquid crystal display device used in the embodiment is a liquid crystal display device of a so-called IPS type (or a lateral electric field type) in which both pixel electrodes and a counter electrode (common electrode) are disposed in the TFT substrate 120 chosen from between the TFT substrate 120 and the counter substrate 150.

Figure 2:
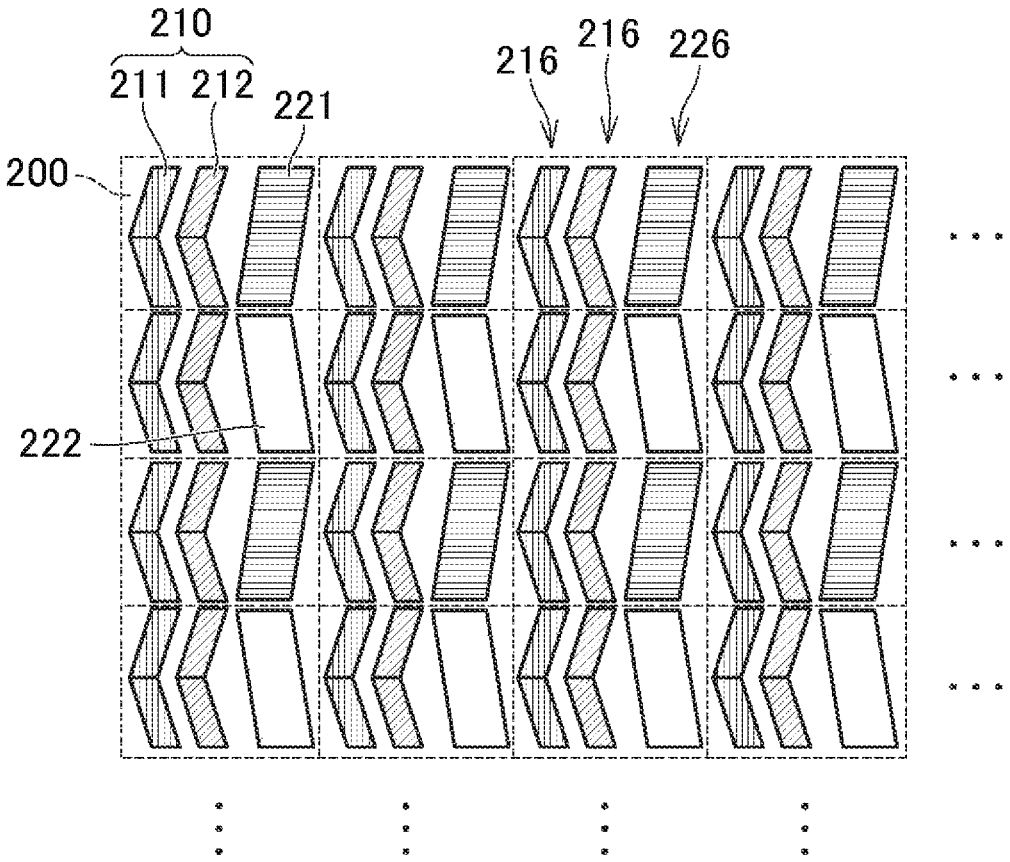
FIG. 2 is a diagram schematically showing pixels disposed in a matrix and the arrangement of sub-pixels of the pixels.

FIG. 2 is a diagram schematically showing the pixels 200 disposed in a matrix and the arrangement of sub-pixels of the pixels 200. In the drawing, the shape of each of the sub-pixels schematically shows an area where each of pixel electrodes is disposed. As shown in the drawing, each of the pixels 200 is configured to include three red (R), green (G), and blue (B) sub-pixels, or three R, G, and white (W) sub-pixels, and emits lights corresponding to the respective wavelength ranges. Here, the R and G sub-pixels are disposed to be respectively aligned in the vertical direction in the display area 205. The B and W sub-pixels are disposed to be alternately aligned in the vertical direction. Hereinafter, a vertical alignment of sub-pixels is also referred to as a "column", while a horizontal alignment of sub-pixels is also referred to as a "row". Moreover, R, G, B, and W sub-pixels mean sub-pixels in which red, green, blue, and white color filters are stacked, respectively. The white color filter is a color filter formed of a transparent resin, or one provided with an opening to allow respective red, green, and blue wavelength lights to transmit therethrough.

Each of the R sub-pixel 211 and the G sub-pixel 212 includes a first pixel 210 having the shape of an arrangement area of a dogleg-shaped pixel electrode that extends in two different directions inclined to the column direction. The shapes of arrangement areas of pixel electrodes of the B sub-pixel and the W sub-pixel show a second pixel 221 and a third pixel 222, respectively, having the shapes each of which extends in one direction inclined to the column direction. Here, a column in which the first pixels 210 are aligned is referred to as a first configuration column 216, while a column in which the second pixel 221 and the third pixel 222 are alternately aligned is referred to as a second configuration column 226.

In the embodiment, the width of each of the second pixel 221 and the third pixel 222, in the row direction, that constitute the second configuration column 226 is formed to be larger than the width of the first pixel 210 in the row direction, and an opening of each of the second pixel 221 and the third pixel 222 is made larger, so that the area of each of the second pixel 221 and the third pixel 222 each of which includes pixels whose number is about half of that of the R sub-pixel 211 or the G sub-pixel 212 is compensated. In the invention, however, the width of each of the second pixel 221 and the third pixel 222 in the row direction may be the same or smaller than the width of the R sub-pixel 211 or the G sub-pixel 212 in the row direction.

Figure 3:
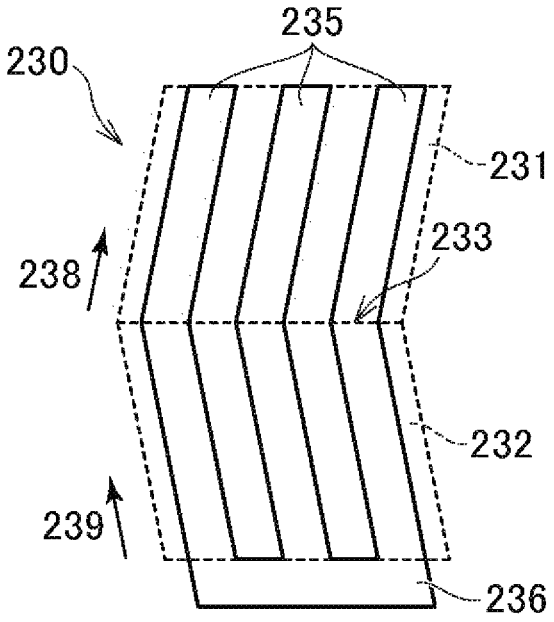
FIG. 3 is a diagram showing an exemplary shape of a first pixel electrode used in a first pixel.

FIG. 3 is a diagram showing an exemplary shape of a first pixel electrode 230 used in the first pixel 210. In FIG. 3 and FIGS. 4 to 8 described later, an illustration of a contact hole or the like for connection with a pixel transistor is omitted. As shown in FIG. 3, the first pixel electrode 230 has a comb-teeth shape as a whole, and includes a comb-teeth portion 235 including three electrodes and a connecting portion 236 connecting the three electrodes to each other. The comb-teeth portion 235 is a portion to form an electric field for aligning a liquid crystal composition in cooperation with the counter electrode. The comb-teeth portion 235 includes a first area 231 extending in a first direction 238 inclined to the column direction (extending direction of the column), and a second area 232 extending in a second direction 239 inclined differently from the first direction 238 via a bent portion 233, so that a so-called dual-domain pixel electrode is provided. Since such a dual-domain pixel electrode is provided, it is possible to suppress a reduction in image quality according to viewing angles such as blue discoloration or yellow discoloration. The first direction 238 and the second direction 239 are symmetrical about the extending direction of the column.

Figure 4:
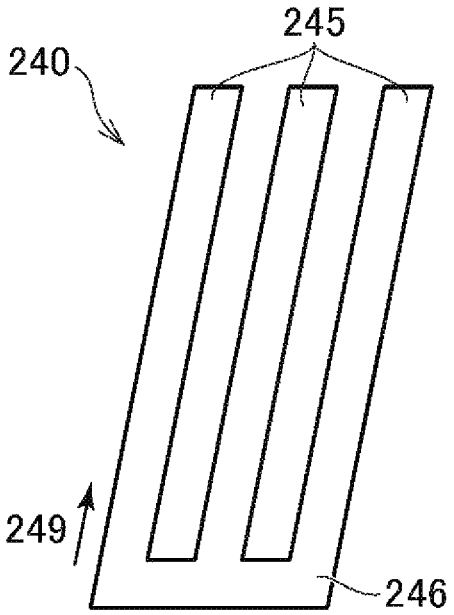
FIG. 4 is a diagram showing an exemplary shape of a second pixel electrode used in a second pixel.

FIG. 4 is a diagram showing an exemplary shape of a second pixel electrode 240 used in the second pixel 221. As shown in the drawing, the second pixel electrode 240 has a comb-teeth shape as a whole similarly to the first pixel electrode 230, and includes a comb-teeth portion 245 including three electrodes and a connecting portion 246 connecting the three electrodes to each other. The comb-teeth portion 245 includes the plurality of electrodes extending in a third direction 249 inclined to the column direction.

Figure 5:
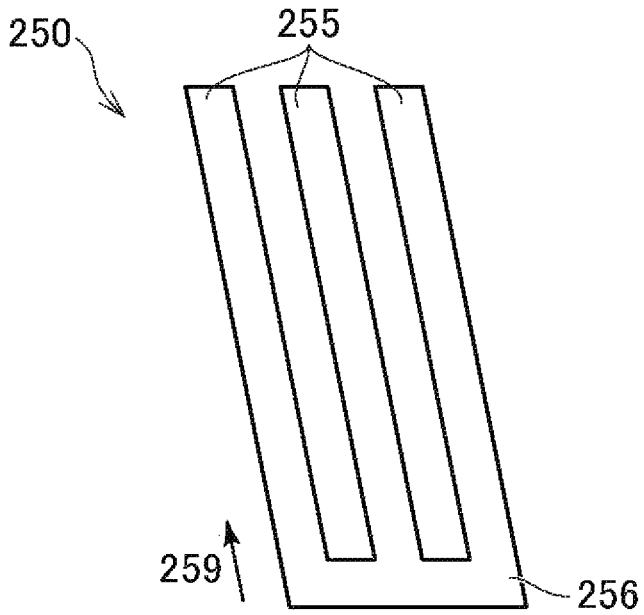
FIG. 5 is a diagram showing an exemplary shape of a third pixel electrode used in a third pixel.

FIG. 5 is a diagram showing an exemplary shape of a third pixel electrode 250 used in the third pixel 222. Similarly to the second pixel electrode 240 in FIG. 4, the third pixel electrode 250 has a comb-teeth shape as a whole, and includes a comb-teeth portion 255 including three electrodes and a connecting portion 256 connecting the three electrodes to each other. The comb-teeth portion 255 includes the plurality of electrodes extending in a fourth direction 259 inclined differently from the third direction 249. The third direction 249 and the fourth direction 259 are symmetrical about the extending direction of the column.

As described above, the second pixel electrode 240 and the third pixel electrode 250 are directed in different directions inclined to the column direction, and with the second and third pixel electrodes acting as a dual-domain pixel electrode together, a reduction in image quality according to viewing angles is suppressed. Moreover, since the second pixel electrode 240 and the third pixel electrode 250 are not provided with the bent portion 233 compared to the first pixel electrode 230, it is possible in the second pixel 221 and the third pixel 222 to suppress a reduction in transmittance due to non-alignment of a liquid crystal composition at the bent portion 233 and improve the transmittance compared to that in the presence of the bent portion 233.

In FIGS. 4 and 5, the second pixel electrode 240 has a positive slope shape, and the third pixel electrode 250 has a negative slope shape. However, the second pixel electrode 240 may have a negative slope shape, and the third pixel electrode 250 may have a positive slope shape. Moreover, although each of the pixel electrodes includes the comb-teeth portion including three electrodes in the embodiment, the comb-teeth portion may include two or more electrodes. The connecting portion is formed at an end of the comb-teeth portion, but maybe formed in the middle or center of the comb-teeth portion. The counter electrode may have a shape extending over the entire display area, or maybe an electrode in which a comb-teeth is formed for each of sub-pixels or may have other electrode shapes.

Figure 6:
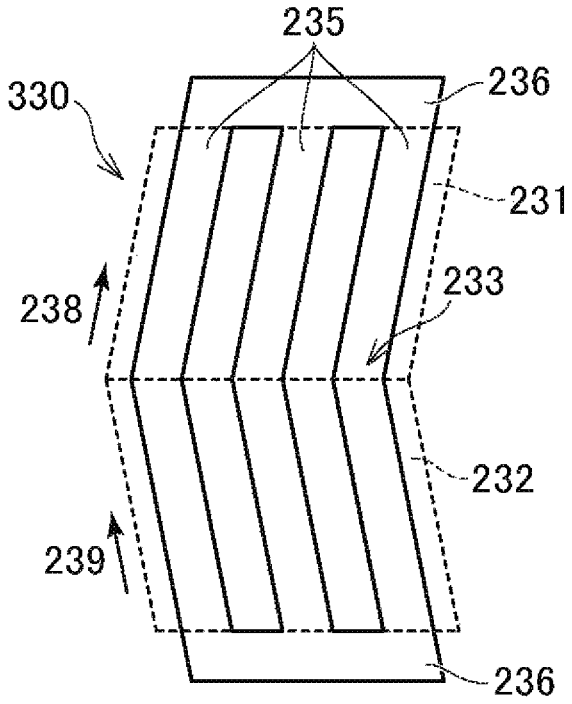
FIG. 6 is a diagram showing a first pixel electrode as a modified example corresponding to the first pixel electrode in FIG. 3.
Figure 7:
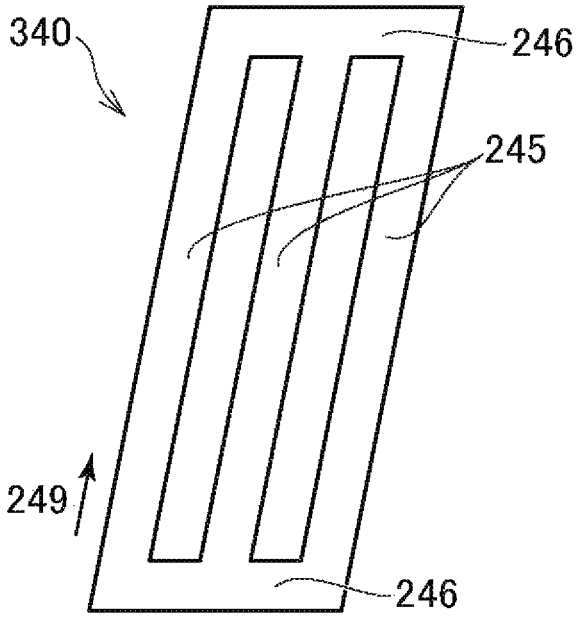
FIG. 7 is a diagram showing a second pixel electrode as a modified example corresponding to the second pixel electrode in FIG. 4.
Figure 8:
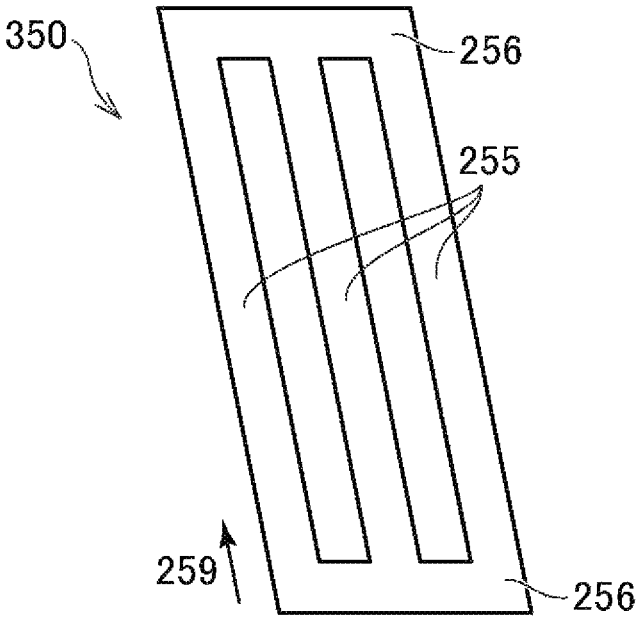
FIG. 8 is a diagram showing a third pixel electrode as a modified example corresponding to the third pixel electrode in FIG. 5.

FIGS. 6 to 8 are diagrams showing a first pixel electrode 330, a second pixel electrode 340, and a third pixel electrode 350 as modified examples respectively corresponding to the first pixel electrode 230, the second pixel electrode 240, and the third pixel electrode 250 in FIGS. 3 to 5. As shown in FIGS. 6 to 8, the modified examples differ from FIGS. 3 to 5 in that respective connecting portions 236, 246, and 256 are provided at two places so as to connect the comb-teeth portions 235, 245, and 255 at both ends. Any shape allowing a dual-domain structure to be formed in the first pixel 210, the second pixel 221, and the third pixel 222, including the shapes of the pixel electrodes in FIGS. 6 to 8, can be used for the pixel electrodes.

Although the second pixel 221 and the third pixel 222 are sub-pixels that emit different color lights in the embodiment described above, the second pixel and the third pixel may be sub-pixels that emit the same color light. Moreover, although the embodiment described above is configured to include two first configuration columns 216 and one second configuration column 226, it is sufficient that the combination of the first configuration column and the second configuration column includes at least one first configuration column and at least one second configuration column such as, for example, a configuration composed of one first configuration column 216 and one second configuration column 226, and the combination can be appropriately changed. Moreover, although the embodiment described above includes the sub-pixels that emit four R, G, B, and W color (wavelength range) lights, the invention can be applied to a liquid crystal display device including sub-pixels that emit three R, G, and B color lights or two or more color lights.

COMPARATIVE EXAMPLES

Figure 9:
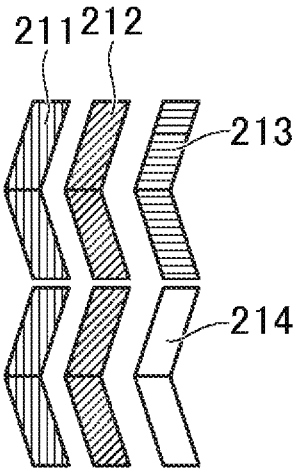
FIG. 9 is a diagram showing Comparative Example 1 in which pixels each including three sub-pixels emit R, G, B, and W lights.
Figure 10:
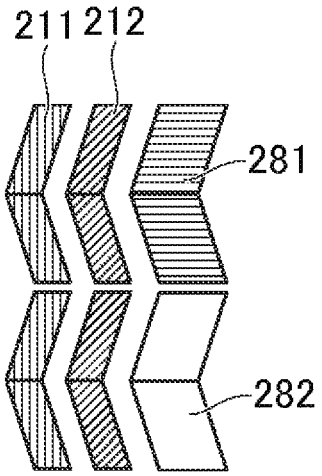
FIG. 10 is a diagram showing Comparative Example 2 in which pixels each including three sub-pixels emit R, G, B, and W lights.

FIGS. 9 and 10 are diagrams showing Comparative Example 1 and Comparative Example 2, respectively, in which pixels each including three sub-pixels emit R, G, B, and W lights. As shown in FIG. 9, when the respective sub-pixels are formed as the dual-domain first pixels 210 having the same size, the opening area of each of the B sub-pixel 213 and the W sub-pixel 214 is half that of the R sub-pixel 211 and the G sub-pixel 212, and thus there is a risk of failing to obtain a sufficient light intensity in the respective wavelength ranges. Therefore, as shown in FIG. 10, the B sub-pixel and the W sub-pixel are extended in the row direction to increase the areas, so that the B sub-pixel 281 and the W sub-pixel 282 can be provided. However, when the areas where some pixel electrodes are disposed are increased like the B sub-pixel 281 and the W sub-pixel 282, an optimum common voltage to be applied to the counter electrode differs from an optimum common voltage for other pixel electrodes. As a result, there is a risk of leading to deterioration of display image quality. Hence, there are limitations on increasing the arrangement area of the pixel electrode by increasing the opening area.

Hence, according to the embodiment described above as shown in FIG. 2, also the sub-pixel whose number is insufficient compared to that of the R sub-pixel 211 or the G sub-pixel 212 is configured without the bent portion in the pixel electrode, like the B sub-pixel and the W sub-pixel. Therefore, the transmittance can be improved, the transmittances in the respective sub-pixels are uniformed, and it is possible to provide a liquid crystal display device whose overall transmittance is improved. Moreover, with the improved transmittance, power consumption can be suppressed. According to the embodiment as described above, even when the areas of some color pixels are insufficient, the effective areas of the some color pixels can be increased by combinations of colors with respect to an array of pixels.

Figure 11:
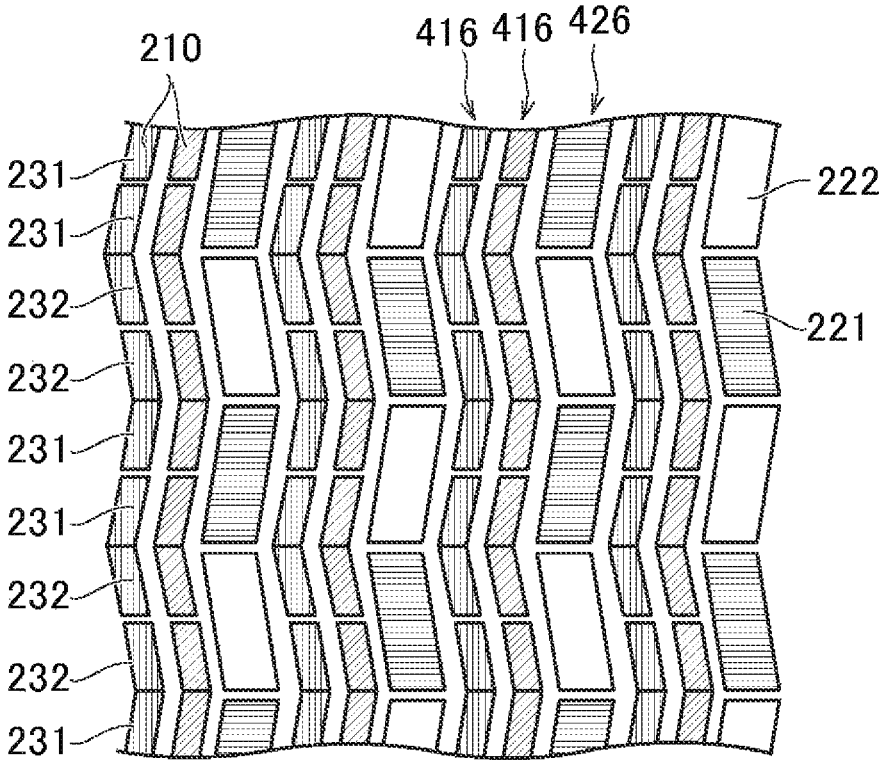
FIG. 11 is a diagram showing a modified example of the embodiment in the same field of view as FIG. 2.

FIG. 11 is a diagram showing a modified example of the embodiment described above. Two first configuration columns 416 are disposed such that the bending direction thereof at the bent portion are different every row. With this configuration, the first pixel 210 in which a first area 231 and a second area 232 are aligned in this order in the column direction and the first pixel 210 in which, in turn, the second area 232 and the first area 231 are aligned in this order in the column direction are alternately disposed. That is, between pixels in which the first pixels 210 are aligned, the first areas 231 or the second areas 232 are successively disposed. In a second configuration column 426, the second pixel 221 is disposed adjacent to an area where two first areas 231 are aligned, with an area between two first pixels 210 that are aligned in the column direction interposed between the two first areas 231, and the third pixel 222 is disposed adjacent to an area where two second areas 232 are aligned.

Here, the third direction 249 of the second pixel electrode 240 is set to the first direction 238 of the first pixel electrode 230, and the fourth direction 259 of the third pixel electrode 250 is set to the second direction 239 of the first pixel electrode 230, that is, the first direction 238 and the third direction 249 are substantially the same direction, and the second direction 239 and the fourth direction 259 are substantially the same direction, whereby the display area 205 can be filled with the pixel electrodes without making gaps. With this configuration, the overall transmittance in the display area 205 can be improved, and also, the power consumption can be suppressed.

Figure 12:
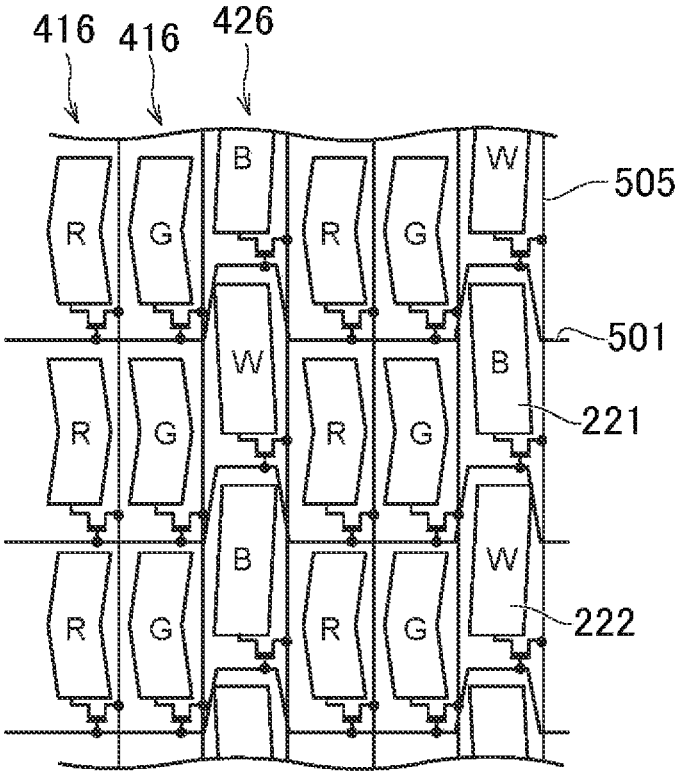
FIG. 12 shows an exemplary arrangement of scanning signal lines in the modified example of FIG. 11.
Figure 13:
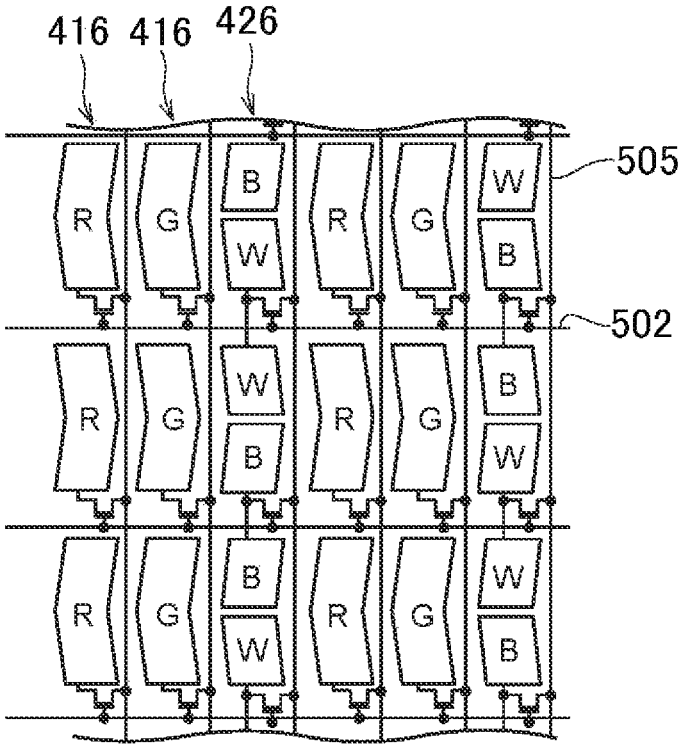
FIG. 13 shows an exemplary arrangement of scanning signal lines in the modified example of FIG. 11.

FIGS. 12 and 13 each show an exemplary arrangement of scanning signal lines in the modified example of FIG. 11. These drawings show the arrangement of wires, in which the respective sub-pixels only schematically shows the arrangement positions thereof and do not precisely show the shapes thereof. In the modified example of FIG. 11, the second configuration column 426 in which the B and W sub-pixels are disposed is shifted in the column direction by half pitch from the first configuration columns 416 in which the R and G sub-pixels are disposed, which affects the arrangement of the scanning signal lines extending in the row direction.

In FIG. 12, scanning signal lines 501 are disposed such that positions through which the scanning signal line 501 passes are different between the first configuration column 216 and the second configuration column 226, and that the scanning signal line 501 extends in the row direction while bending. With the arrangement described above, even when a column that is shifted in the column direction by half pitch is present, the scanning signal line can be disposed.

FIG. 13 shows an example in which each of scanning signal lines 502 is disposed so as to divide the sub-pixels of the second configuration column 226 and extend in one direction without being bent. In the example of FIG. 12, since the overlapping area of the scanning signal line 501 and a video signal line 505 is increased, a parasitic capacitance occurs, and thus there is a risk of leading to deterioration of a display image. However, the parasitic capacitance can be suppressed by dividing the B and W sub-pixels of the second configuration column 226 and disposing the scanning signal line 502 between the B and W sub-pixels as in FIG. 13, so that the quality of a display image can be improved.

While there have been described what are at present considered to be certain embodiments of the invention, it will be understood that various modifications may be made thereto, and it is intended that the appended claims cover all such modifications as fall within the true spirit and scope of the invention.

What is claimed is:

1. A liquid crystal display device comprising a display area having a plurality of pixels arranged in a row direction and in a column direction, the plurality of pixels including first pixels and second pixels alternately arranged in the column direction, the display area including first configuration columns and second configuration columns, each of the first configuration columns being a column having a plurality of first sub-pixels aligned therein, the plurality of first sub-pixels each including a first pixel electrode including a first area and a second area, the first area extending in a first direction inclined to the column direction, the second area extending in a second direction inclined differently from the first direction, each of the second configuration columns being a column having a plurality of second sub-pixels and a plurality of third sub-pixels alternately aligned therein, the plurality of second sub-pixels each including a third area having a second pixel electrode extending in a third direction inclined to the column direction, the plurality of third sub-pixels each including a fourth area having a third pixel electrode extending in a fourth direction inclined differently from the third direction, wherein each of the first sub-pixels has at least a corresponding one of the first sub-pixels in at least a corresponding one of the first configuration columns and a corresponding one of the second sub-pixels in a corresponding one of the second configuration columns, each of the second sub-pixels has at least a corresponding one of the first sub-pixels in at least a corresponding one of the first configuration columns and a corresponding one of the third sub-pixels in a corresponding one of the second configuration columns, the first area in each of the first sub-pixels has a first edge that is opposed to and is a first distance apart from the third area in the row direction, the first area in each of the first sub pixels has a second edge that is opposed to and is a second distance apart from the fourth area in the row direction, and each of the first distance and the second distance varies depending on a measurement position and is maximized from a boundary of the first area and the second area.

2. The liquid crystal display device according to claim 1, wherein each of the plurality of second and third sub-pixels is wider in the row-direction than any one of the plurality of first sub-pixels in the row-direction.

3. The liquid crystal display device according to claim 1, wherein the first configuration columns include:

first columns, each of the first columns including the plurality of first sub-pixels that are configured to emit light in a red wavelength range; and second columns, each of the second columns including the plurality of first sub-pixels that are configured to emit light in a green wavelength range, and the plurality of second sub-pixels are configured to emit light in one of blue and white wavelength ranges, and the plurality of third sub-pixels are configured to emit light in the other of the blue and white wavelength ranges.

4. A liquid crystal display device comprising:

a first column having a plurality of first sub-pixels aligned therein; and a second column having second sub-pixels and third sub-pixels alternately aligned therein, the plurality of first sub-pixels each including a first electrode in a first area and a second electrode in a second area, the first area and the second area being connected to each other, the first electrode extending in a first direction inclined to an extending direction of the first column, the second electrode extending in a second direction inclined differently from the first direction, the second sub-pixels each including a third electrode in a third area, the third electrode extending in a third direction inclined to an extending direction of the second column, the third sub-pixels each including a fourth electrode in a fourth area, the fourth electrode extending in a fourth direction inclined differently from the third direction, the first direction and the second direction being symmetrical about the extending direction of the first column, the third direction and the fourth direction being symmetrical about the extending direction of the second column, a connecting portion between the first area and the second area being bent from the first direction toward the second direction, the third electrode not being bent from the third direction toward the fourth direction, and the fourth electrode not being bent from the fourth direction toward the third direction, the first column and the second column are arranged side by side in a row direction, the first area in each of some of the first sub-pixels have a first edge that is opposed to and is a first distance apart from the third area in the row direction, the first area in each of the other first sub-pixels have a second edge that is opposed to and is a second distance apart from the fourth area in the row direction, and each of the first distance and the second distance varies depending on a measurement position and is maximized from the connecting portion between the first area and the second area.

5. The liquid crystal display device according to claim 4, wherein each of the third electrode and the fourth electrode is wider than the first electrode.

6. The liquid crystal display device according to claim 4, wherein each of the plurality of first sub-pixels is configured to emit light in a red wavelength range or light in a green wavelength range, each of the second sub-pixels is configured to emit light in a blue wavelength range, and each of the third sub-pixels is configured to emit lights in the red, green, and blue wavelength ranges.

* * * * *